US008064815B2

(12) United States Patent
Gibson et al.

(10) Patent No.: US 8,064,815 B2
(45) Date of Patent: Nov. 22, 2011

(54) WRAP SPRING CLUTCH AUGER

(75) Inventors: Nicholas Fenley Gibson, Lexington, KY (US); David Lee Merrifield, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 12/721,800

(22) Filed: Mar. 11, 2010

(65) Prior Publication Data

US 2011/0222939 A1 Sep. 15, 2011

(51) Int. Cl.
*G03G 21/00* (2006.01)

(52) U.S. Cl. ..... 399/358; 399/120; 399/256

(58) Field of Classification Search ..... 399/119, 399/120, 252, 256, 264, 343, 358–360
See application file for complete search history.

(56) References Cited

U.S. PATENT DOCUMENTS 4,980,724 A * 12/1990 Tanaka ..... 399/256
5,202,728 A * 4/1993 Maeshima et al. ..... 399/114
2005/0019066 A1* 1/2005 Ito et al. ..... 399/302

* cited by examiner

*Primary Examiner* — David Porta
*Assistant Examiner* — Benjamin Schmitt

(57) ABSTRACT

An apparatus for moving waste toner within a printer cartridge includes an auger having a radially inward facing surface, the radially inward facing surface defining an opening having an inner diameter. An elongated drive shaft has an outer surface defining an outer diameter, the outer diameter of the drive shaft being greater than the inner diameter of the auger. The radially inward facing surface of the auger engages the outer surface of the drive shaft with a first pressure when the drive shaft is rotated within the opening of the auger in a first direction with a first load applied on the auger.

20 Claims, 6 Drawing Sheets

WRAP SPRING CLUTCH AUGER

REFERENCES TO RELATED APPLICATION

This patent application is related to U.S. patent application Ser. No. 12/709,767, filed Feb. 22, 2010, titled "Device for Moving and Storing Waste Toner in an Imaging Apparatus". The contents of this application are hereby incorporated by reference herein in its entirety.

BACKGROUND

1. Field of the Invention

The present invention relates generally to printer cartridges and particularly to a drive shaft-auger arrangement used within a cleaner assembly for moving waste toner within the printer cartridge.

2. Description of the Related Art

Inside each print cartridge, unusable "waste" toner is created as a byproduct of an electro photography (EP) process. All of the toner that is picked up by a photoconductive drum from a developer roll is ideally transferred onto a media sheet or a transfer belt in the case of a two-step toner transfer process. However, due to inefficiencies within the transfer process, all of the toner put on the photoconductive drum by the developer roll does not get transferred to the media sheet or transfer belt. The waste toner left on the photoconductive drum after it has contacted the media sheet or transfer belt must be removed so a clean photoconductive drum can be written to again by a laser. For this reason, a cleaner blade is placed in constant contact with the photoconductive drum to wipe the waste toner from its surface before it is re-charged and imaged again. This cleaner blade prevents the waste toner from a previous photoconductive drum revolution from contaminating the toner developed during the next photoconductive drum revolution. The waste toner removed by the cleaner blade falls into a sealed waste toner compartment disposed beside the photoconductive drum to prevent it from being distributed inside the printer.

The waste toner collected during transfer must be properly stored inside the waste toner compartment. As the photoconductive drum is in contact with the media sheet or transfer belt, there is very little storage space for waste toner around the cleaner blade. Generally, an auger is positioned in a cleaner housing disposed adjacent to the photoconductive drum. Rotational motion of the auger allows the waste toner to be delivered to the waste toner compartment from the photoconductive drum. Augers have proved to be an effective means of moving toner from one area to another for a wide variety of toner applications.

Augers used for transferring waste toner are usually made from either molded plastic or metal wire stock. However, each of these types of augers has its own drawbacks. For example, injection molded plastic augers have proved to be easier to manufacture compared to the metal wire variety. In addition, providing a drive for a plastic auger is more straightforward because the drive shaft for the auger can be molded in the same cavity as the helix, resulting in a simple one piece design. However, the problem with the plastic molded augers is that these are most often resistant to bending and can only transfer waste toner in straight channels. Comparatively, the metal wire augers have an advantage of being able to bend during waste toner transfer and as a result transfer the waste toner through a curved channel thereby effectively.

A barrier for practical implementation of metal wire augers is the need for a metal drive shaft used to connect the auger with its drive source. Having a metal drive shaft on which to fix the auger is advantageous in that the auger can be soldered or welded onto the drive shaft without an attachment part such as a screw, pin or other retainer. However, metal drive shafts add significant cost to the overall auger design, decreasing its likelihood for use in production laser cartridges.

Some manufacturers have used a plastic drive shaft instead of metal drive shaft to reduce some of the above problems faced by the metal drive shafts. For example, the cost of the drive component is reduced substantially by using plastic instead of a machined or cast metal part. Also, an additional processing station such as welding or soldering is not needed if the drive is made from plastic. Finally, a plastic drive shaft makes it easier to attach the gearing that is needed to turn the assembly.

However, securing or coupling the metal auger to the plastic drive shaft is a significant obstacle in designing a plastic drive shaft. The coupling mechanism must fit inside the auger channel without interference in order for the auger to turn freely. Further, the size of the coupling mechanism is also generally very small, making it difficult to transmit the torque needed without risk of breakage. An alternative employment of a coupling mechanism between the auger and the plastic drive shaft is to mold the auger into the plastic drive shaft to form a unitary device. Unfortunately, this method is very sensitive to manufacturing parameters and is a much more expensive alternative to hand assembly.

Thus, there is a need to provide a secure coupling between an auger and corresponding drive shaft that addresses at least some of the above problems and still provide a reliable waste toner removal operation from the photoconductive drum to the waste toner compartment in a printer cartridge.

SUMMARY OF THE INVENTION

Disclosed herein is an apparatus for moving waste toner within an electrophotographic printer that includes an auger having a length extending between two ends and having a radially inward facing surface, the radially inward facing surface defining an opening having an inner diameter, the opening extending along at least a portion of the length of the auger. The apparatus further includes a drive shaft disposed within the auger opening and having an outer surface such that the outer diameter of the drive shaft is greater than the inner diameter of the auger in the absence of engagement. The radially inward facing surface of the auger engages the outer surface of the drive shaft with a first pressure when the drive shaft is rotated in a first direction by a drive mechanism. This substantially non-slip engagement provides secure attachment between the auger and the drive shaft such that the auger may serve to effectively move waste toner from the area around the photoconductive drum without the need for an additional mechanism for coupling together the auger and drive shaft. As a result, no additional components are needed to engage or otherwise connect the auger to the drive shaft.

In another aspect, the apparatus may include a waste toner box in which a portion of the auger may extend.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is understood that both the foregoing general description and the following detailed description of the present embodiments of the invention and are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and together with the description serve to explain the principles and operation of the invention.

BRIEF DESCRIPTION OF THE DRAWINGS

The above-mentioned and other features and advantages of the various embodiments of the invention, and the manner of attaining them, will become more apparent and will be better understood by reference to the accompanying drawings, wherein.

DETAILED DESCRIPTION

Figure 1:
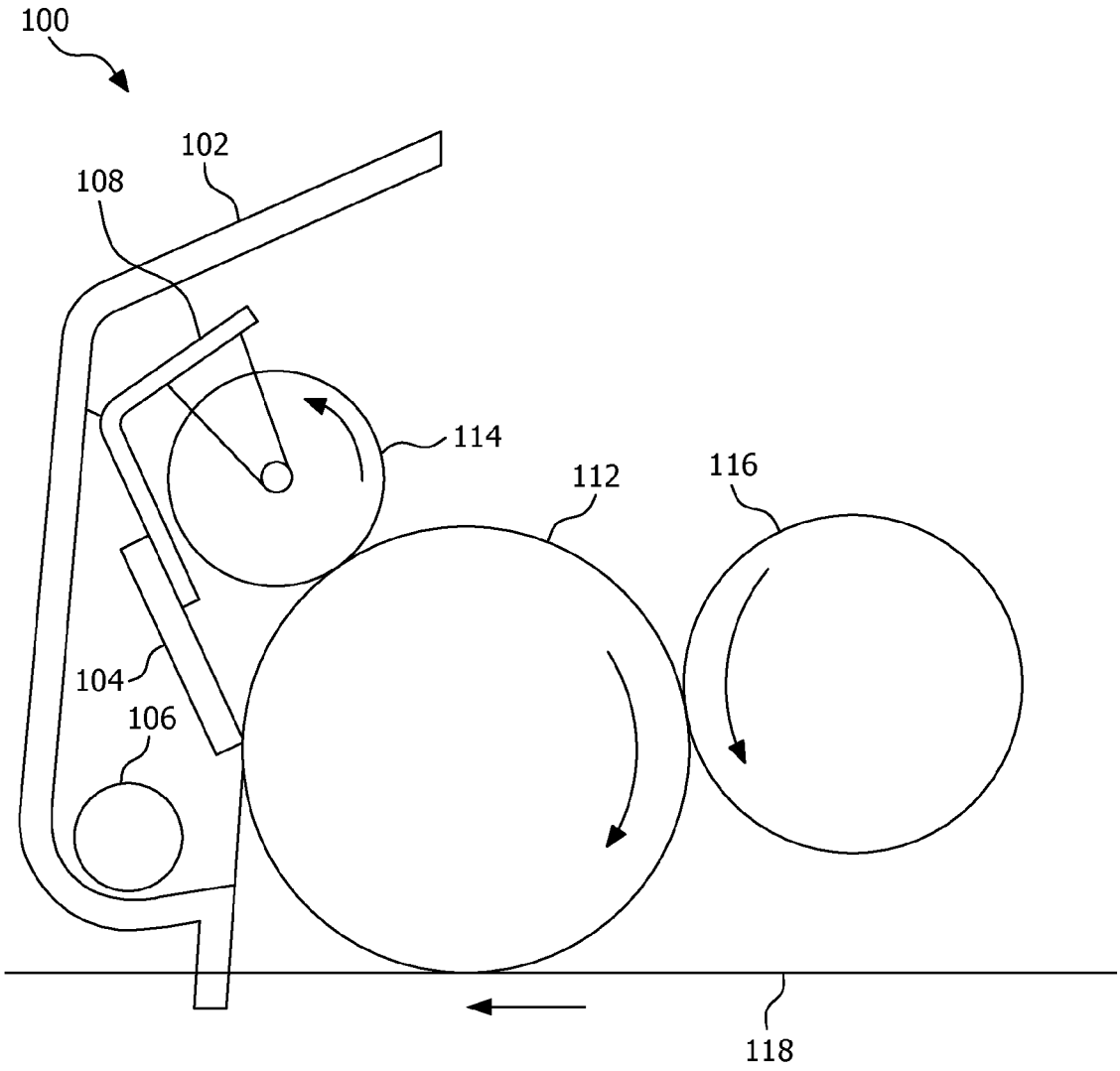
FIG. 1 is a side elevational view of an embodiment of a cleaner assembly for waste toner removal operably connected with a photoconductive drum according to the present invention.

Reference will now be made in detail to the exemplary embodiment(s) of the invention, as illustrated in the accompanying drawings. Whenever possible, the same reference numerals will be used throughout the drawings to refer to the same or like parts.

Figure 3:
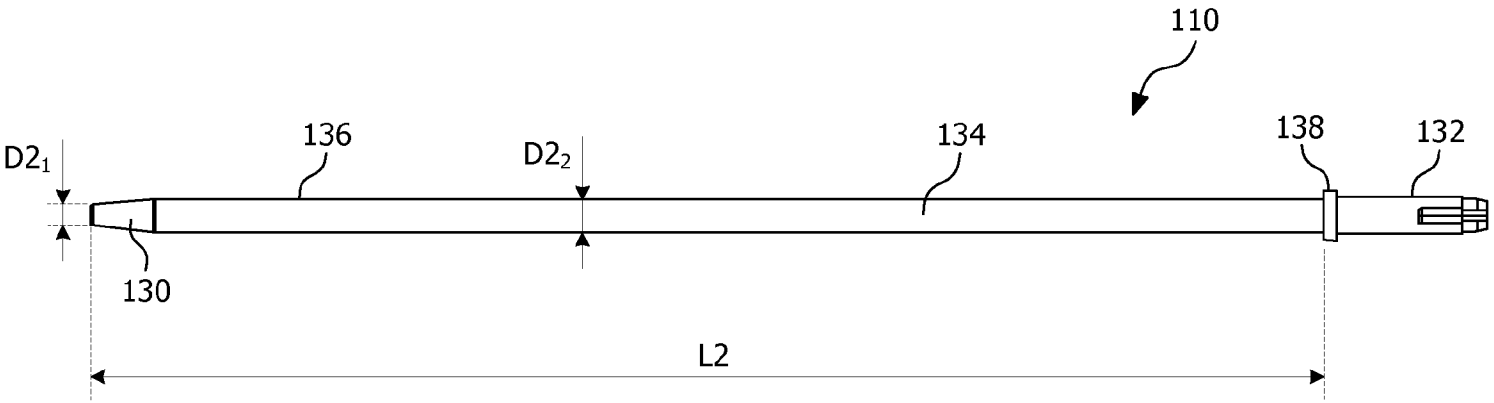
FIG. 3 is a side view of a drive shaft that is disposed within the cleaner assembly of FIG. 1.

FIG. 1 illustrates one embodiment of a cleaner assembly 100 according to the present invention. The cleaner assembly 100 includes a cleaner housing 102, a cleaner blade 104, and an auger 106 disposed within the cleaner housing 102. A bracket member 108 is attached to the cleaner housing 102 to hold a cleaner blade 104. The auger 106 is disposed within the cleaner housing 102 and operably connected to a drive shaft 110 (FIG. 3). A photoconductive drum 112 is rotated against a charge roller 114 and a developer roll 116 that develops the photoconductive drum 112 with a toner. An intermediate transfer belt 118 passes below the photoconductive drum 112 and receives the toner transferred to the photoconductive drum 112. The cleaner blade 104 contacts an outer surface of the photoconductive drum 112. Thus, any toner that is not transferred from the photoconductive drum 112 to the intermediate transfer belt 118 is removed by the cleaner blade 104. The toner that is removed by the cleaner blade 104 falls into the cleaner housing 102. The auger 106 disposed within the cleaner housing 102 then moves the removed toner and deposits the same into a waste toner box that is connected to the cleaner assembly 100.

Though FIG. 1 depicts a cleaner assembly 100 in association with the first of a two step toner transfer operation, it is understood that cleaner assembly 100 may be utilized with a single step or direct transfer operation utilized in some electrophotographic devices.

Figure 2:
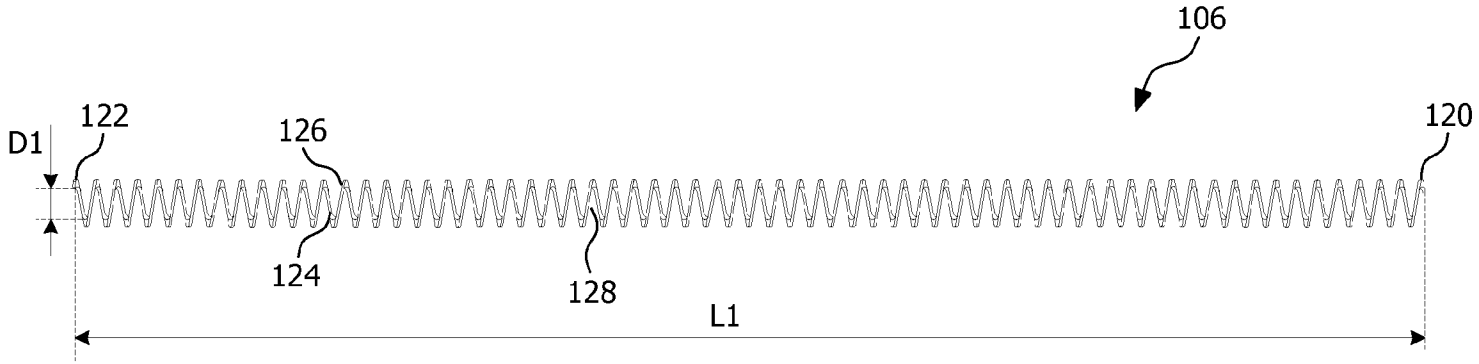
FIG. 2 is a side elevational view of an auger of FIG. 1.

FIG. 2 illustrates the auger 106 that is used within the cleaner housing 102 as noted above. The auger 106 has a first end 120, a second end 122, and a length L1 extending between the first end 120 and the second end 122. The auger 106 is dimensioned to have a radially inward facing surface 124 and an outer surface 126 extending along the length L1 of the auger 106. Further, the radially inward facing surface 124 of the auger 106 defines an opening 128 that extends from the first end 120 to the second end 122 of the auger 106 or along any portion thereof. Furthermore, the opening 128 of the auger 106 has an inner diameter D1 that remains substantially constant. Further, the auger 106 may be a flat wire auger 106 formed in a helical configuration throughout the length L1 of the auger 106. Alternatively, the auger 106 may also be round wire auger 106 and still fall within the scope of the present invention.

In accordance to an exemplary embodiment of the present invention, the auger 106 may be constructed from 1.3 mm×0.6 mm wire stock.

FIG. 3 illustrates a drive shaft 110 having a proximal end portion 130, a distal end portion 132, and a middle portion 134 extending between the proximal end portion 130 and the distal end portion 132. Proximal end portion 130 may have a substantially frustoconical shape. The drive shaft 110 has an outer surface 136 that defines an outer diameter D2. An end of the proximal end portion 130 of the drive shaft 110 has an outer diameter $D2_1$ and the middle portion 134 and the distal end portion 132 has an outer diameter $D2_2$. Further, as shown in FIG. 3, the outer diameter $D2_1$ is smaller that the outer diameter $D2_2$.

The outer diameter $D2_2$ is dimensioned to have a value that is slightly larger than the inner diameter D1 of the auger 106. For example, the difference between the outer diameter $D2_2$ of the drive shaft 110 and the inner diameter D1 of the auger 106 may be between about 0.15 mm and about 0.19 mm, such as about 0.17 mm.

A stopping member 138 is disposed on the drive shaft 110 adjacent to the middle portion 134 and defining a boundary between the middle portion 134 and the distal end portion 132 of the drive shaft 110. The distance between the proximal end portion 130 and the stopping member 138 of the drive shaft 110 is defined by a length L2. When the drive shaft 110 is inserted within the auger 106, the stopping member 138 acts as a barrier to prevent further insertion of the drive shaft 110 within the auger 106. Thus, the auger 106 is positioned on the drive shaft 110 along length L2 thereof.

The drive shaft 110 may be made from a plastic material and the auger 106 from a flexible material, such as a metal. However, the drive shaft 110 may also be made from a metallic material and the auger 106 from a non-metallic material and fall within the scope of the present invention.

Further, a drive mechanism (not shown) is also operatively coupled to the distal end portion 132 of the drive shaft 110. The drive mechanism may include a drive gear disposed on the distal end portion 132 of the drive shaft 110 and an idler gear that engages the drive gear. The idler gear may also engage a photoconductive drum drive used to drive the photoconductive drum 112. Thus, the photoconductive drum drive mechanism is also used to drive the drive shaft 110 disposed within the cleaner housing 102. When the drive shaft 110 is rotated, the auger 106 that is engaged with the drive shaft 110 also rotates, causing the removed toner to move within the cleaner housing 102 and be deposited in the waste toner box connected to the cleaner assembly 100.

Figure 4:
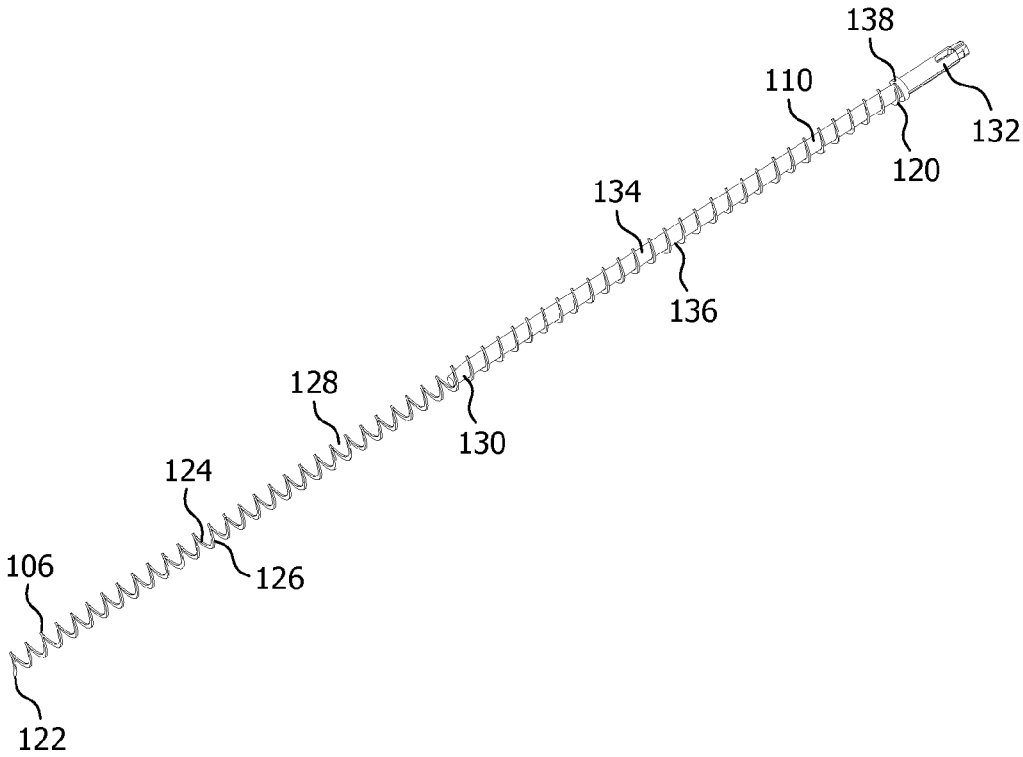
FIG. 4 is a perspective view of the drive shaft engaged with a portion of the auger of FIG. 3.

FIG. 4 shows the drive shaft 110 installed within the opening 128 of the auger 106. The drive shaft 110 is rotated within the opening 128 of the auger 106 with a first load applied thereon until the first end 120 of the auger 106 engages the stopping member 138 of the drive shaft 110. The stopping member 138 prevents further slippage of the outer surface 136 of the drive shaft 110 within the opening 128 of the auger 106. An advantage of auger 106 in FIG. 4 is that it behaves in a manner that is similar to a torsion spring when subject to a load. Accordingly, in exemplary embodiments of the present invention the auger 106 performs substantially like a wrap spring clutch in engaging drive shaft 110.

Figure 5:
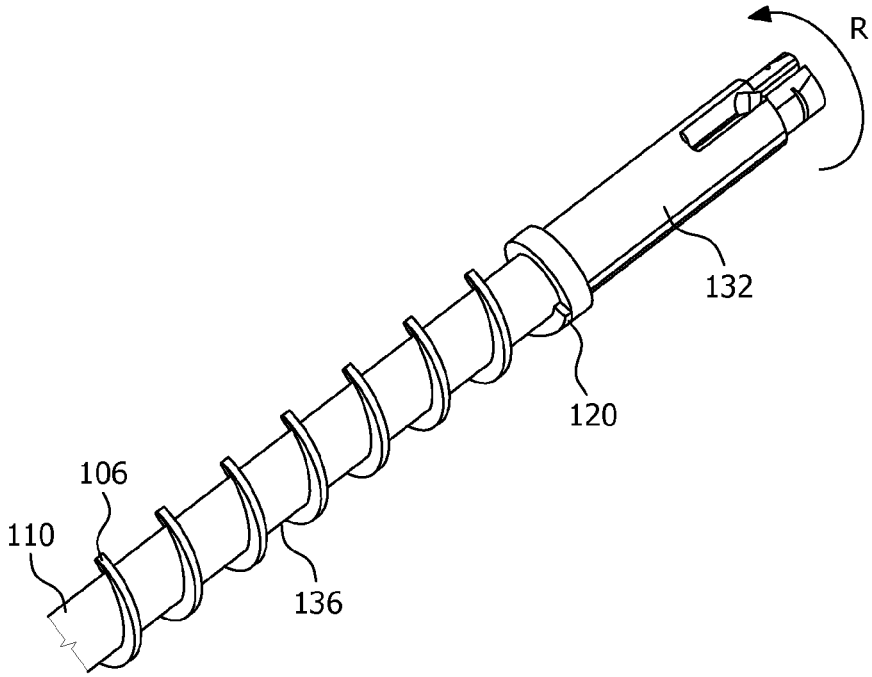
FIG. 5 is a perspective view of a portion of the drive shaft and auger of FIG. 4.

In use, the drive shaft 110 is rotated in a direction R under application of a load by the drive mechanism. Direction R is viewed in FIG. 5 as a clockwise rotation relative to the end of distal end portion 132 of drive shaft 110. The rotation of the drive shaft 110 in the direction R under the applied load causes the auger 106 to contract so that inward facing surface 124 of auger 106 more tightly engages with the drive shaft 110 with a second pressure. This substantially non-slip engagement of the auger 106 with the drive shaft 110 with the second pressure serves to keep the auger 106 securely in place on the drive shaft 110 which thereby allows auger 106 to move toner along cleaner assembly 100.

Figure 6:
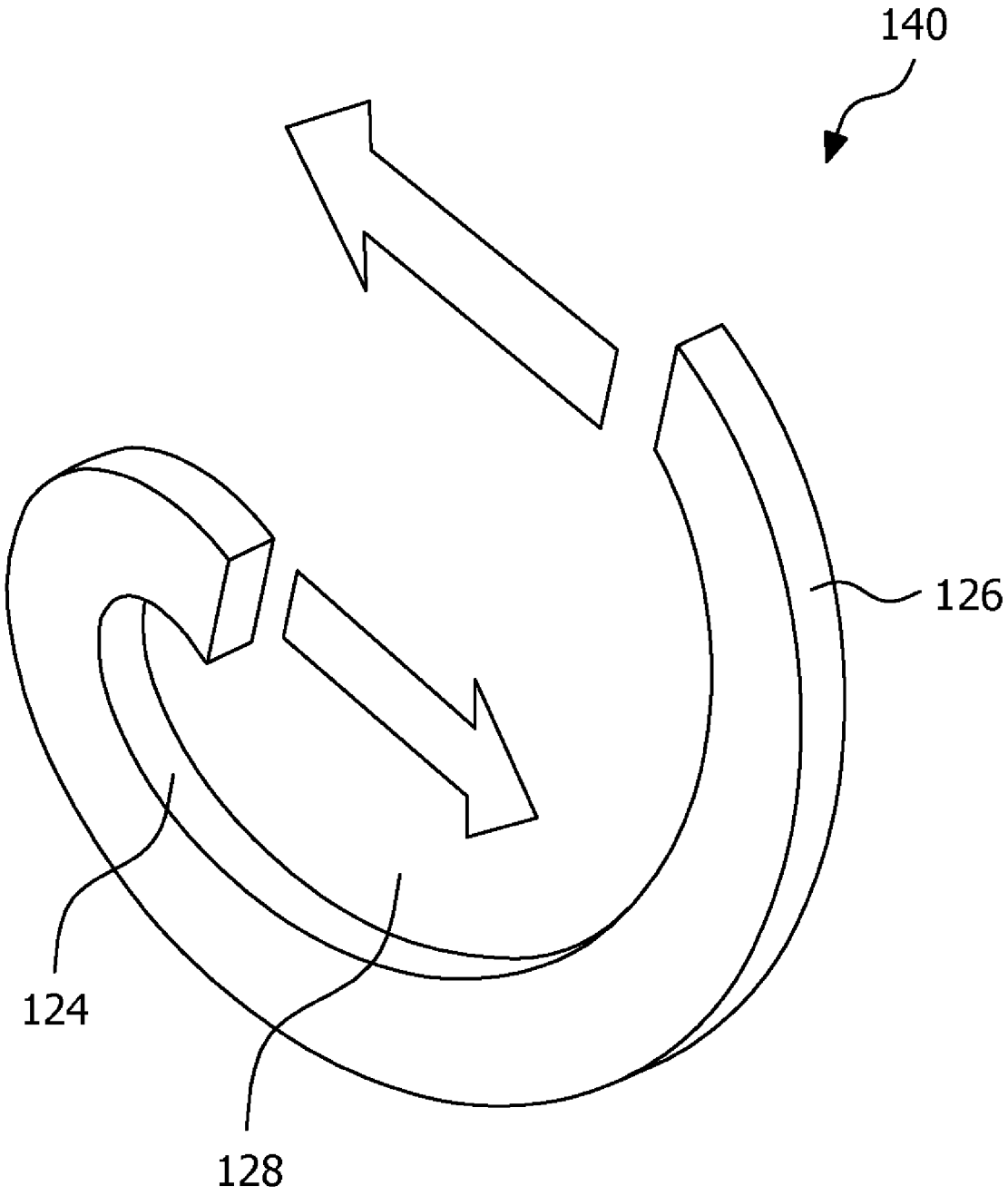
FIG. 6 is a perspective view of an element of the auger of FIG. 5 illustrating forces acting thereon when the drive shaft is rotated.

FIG. 6 illustrates the forces, illustrated by arrows, applied on a single coil 140 of the auger 106 when the drive shaft 110 is rotated in the direction R with the corresponding load applied thereto. It is understood that similar contracting forces are also exerted on the other coils 140 of the auger 106 along the length L2 between the proximal end portion 130 and the stopping member 138 of the drive shaft 110. The contracting forces exerted on the plurality of coils decrease the inner diameter D1 of the auger 106. The contracting forces result in the auger 106 sufficiently engaging the drive shaft 110 so as to rotate therewith, thereby forming a drivable auger. As a result, rotation of the drive shaft 110 with an applied load in the direction R within the cleaner housing 102 results in the auger 106 substantially rotating with the drive shaft 110 and in doing so moving waste toner along cleaner housing 102 towards a waste toner box.

Figure 7:
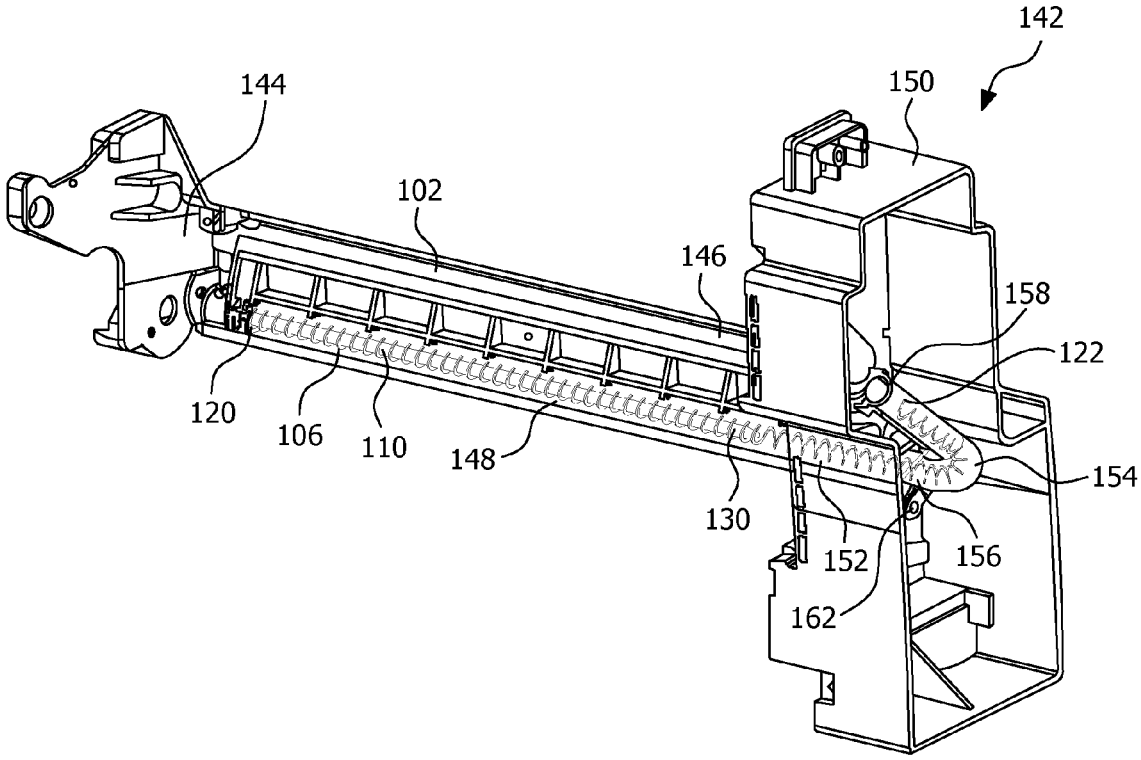
FIG. 7 is a perspective view of the auger of FIG. 2 in association with a waste toner box.

FIG. 7 shows a waste toner box 142 according to exemplary embodiments of the present invention. The waste toner box 142 is connected to the cleaner housing 102. The cleaner housing 102 has a first end 144 and a second end 146 with the waste toner box 142 connected to the second end 146 of the cleaner housing 102. The cleaner housing 102 also has a channel 148 for the flow of waste or removed toner from the photoconductive drum 112 into the waste toner box 142. The drive shaft 110 having the auger 106 engaged therewith is positioned within the channel 148 with the distal end portion 132 of the drive shaft 110 positioned adjacent to the first end 144 of the cleaner housing 102. The proximal end portion 130 of the drive shaft 110 is positioned along the channel 148 of the cleaner housing 102.

FIG. 7 shows the waste toner box 142 having a housing 150 without a back surface for showing the internal components of the waste toner box 142. An inlet 152 is formed within the housing 150 that coincides with an end portion of the channel 148 of the cleaner housing 102. A portion of the auger 106, including the second end 122 thereof, follows a tube 154 mounted inside the waste toner box 142 with little resistance to bending. The second end 122 of the auger 106 is disposed within the tube 154. The tube 154 extends between a first end 156 and a second end 158. The first end 156 of the tube 154 is attached to an inner surface of the waste toner box 142 by known fastening means 162, for example, by a rivet, by a fastener, etc. The second end 158 of the tube 154 extends to a point vertically above the inlet 152 so that the waste toner exiting the tube 154 falls from the top towards the bottom, utilizing the maximum space inside the waste toner box 142.

Both the first end 156 and the second end 158 of the tube 154 are disposed inside the waste toner storage box. The shape of the tube 154 can vary depending on the application, and is curved in the direction best suited to allow the auger 106 to fill the space inside the waste toner box 142 with the remaining toner. A mounting location of the tube 154 coincides with an end portion of the channel 148 and the inlet 152 of the waste toner box 142. This is to ensure that the auger 106 comes out of the channel 148 and enters into the tube 154 with a smooth transition.

As explained above, the drive mechanism is coupled to the distal end portion 132 of the drive shaft 110. The driving mechanism rotates the drive shaft 110 and the auger 106 engaged therewith in the channel 148 of the cleaner housing 102. The waste toner that is collected from the photoconductive drum 112 within the channel 148 of the cleaner housing 102 is moved towards waste toner box 142. Rotation of the auger 106 within the channel 148 pushes the waste toner in a forward direction towards the inlet 152 of the waste toner box 142 and finally in the housing 150 of the waste toner box 142 via the tube 154.

Figure 8:
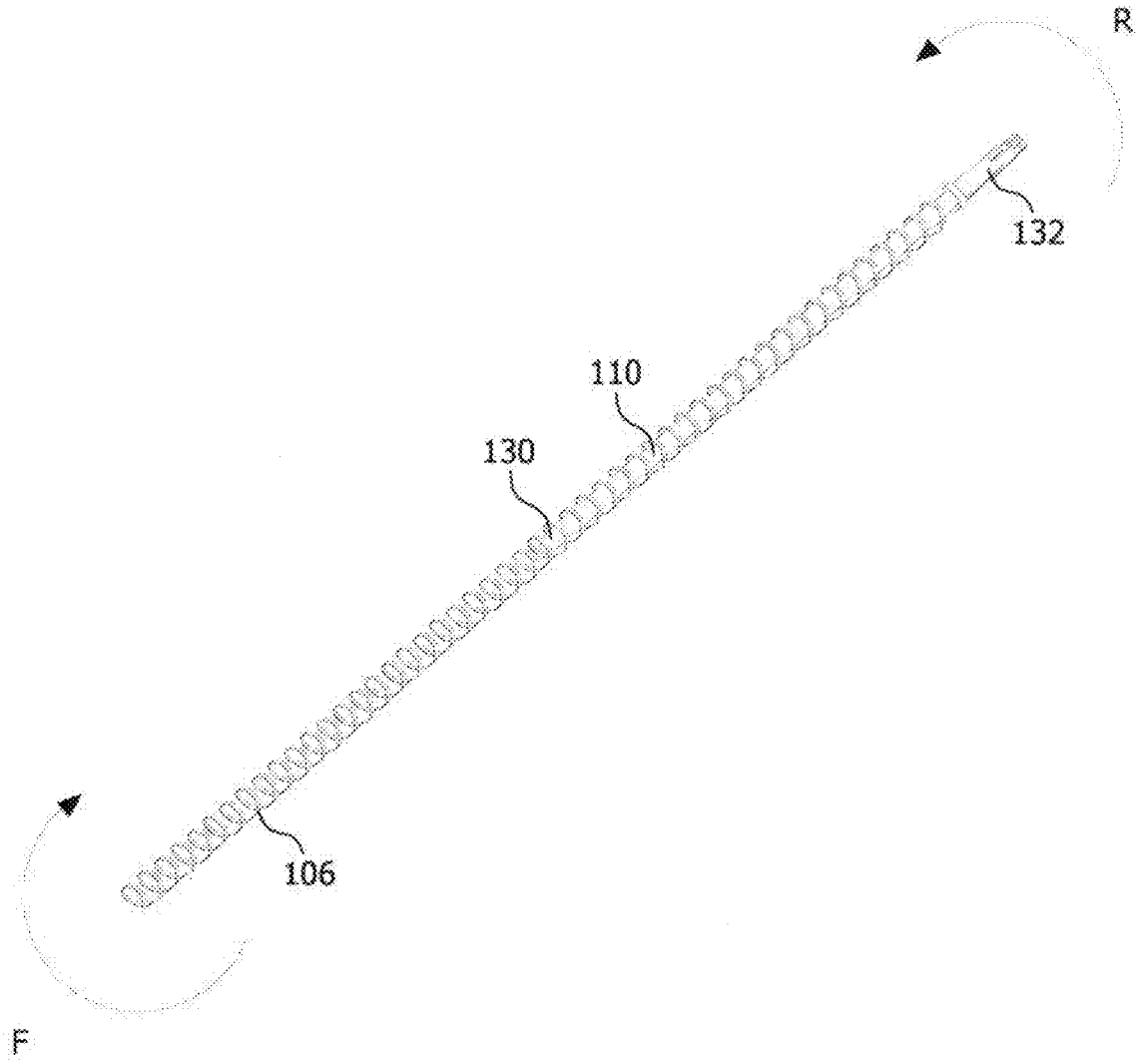
FIG. 8 is a perspective view of the drive shaft and auger illustrating forces applied thereto when in use.

Further, when the waste toner is filled up to approximately a level near the level of second end 158 of tube 154, the waste toner in housing 150 may tend to oppose the rotation of the auger 106. Thus, a contracting force F in a counter-clockwise direction (relative to distal end portion 132) is exerted on the second end 122 of the auger 106. The contracting force F exerted on the second end 122 of the auger 106 in the counter-clockwise direction is shown in FIG. 8. As noted above, the drive shaft 110 and the auger 106 are rotated in the clockwise direction (relative to distal end portion 132) to engage the radially inward facing surface 124 of the auger 106 with the outer surface 136 of the drive shaft 110 and move waste toner as a result. As shown in FIG. 8, the contracting force F exerted on the second end 122 further tends to more tightly engage the auger 106 with the drive shaft 110. Thus, the drive shaft 110 and the auger 106 tend to remain engaged and otherwise locked together during the toner cleaning operation without becoming disengaged, regardless of collected toner levels in housing 150.

Another feature of the auger 106 and the drive shaft 110 is their ability to remain engaged with each other when the photoconductive drum 112 is rotated in a reverse direction. Reverse rotation of the photoconductive drum 112 is used to clean the charge roll nip and is usually relatively brief in duration, such as less than one rotation of the photoconductive drum 112. Because the drive mechanism which drives the photoconductive drum 112 may also drive the drive shaft 110, the drive shaft 110 may be rotated in a reverse direction. In this case, such reverse direction would normally serve to further thread the auger 106 further up the drive shaft 110 towards end portion 130 thereof. However, the stopping member 138 stops the auger 106 from being further threaded up the drive shaft 110, thereby creating an engagement with the auger 106 which causes the auger 106 to rotate with the drive shaft 110 in the reverse direction. Because rotation of the auger 106 in the reverse direction serves to pull toner from waste toner box 142, there is an insufficient amount of torque on the auger 106 to cause it to rotate relative to and/or apart from the drive shaft 110 and the auger 106 remains engaged therewith.

It is understood that the combination of auger 106 and drive shaft 110 may be utilized for moving waste toner that is collected from intermediate transfer belt 118. Specifically, a doctor blade or other device (not shown in the drawings) may engage with the surface of intermediate belt 118 following transfer of toner to a sheet of media and remove any waste toner remaining on belt 118. The waste toner collected from intermediate belt 118 may be moved by auger 106 to a waste toner box like waste toner box 152 described above or a similar receptacle for storing waste toner.

It is further understood that the combination of auger 106 and drive shaft 110 may be utilized not only to move waste toner to a waster toner storage box but also to move or otherwise distribute toner prior to being transferred to a sheet of media or the intermediate transfer belt 118. For example, auger 106 and drive shaft 110 may be utilized to deliver toner to developer roll 116 from a toner cartridge (not shown in the drawings). In this scenario, the toner being delivered by auger 106 is unworked toner, and auger 106 is employed to feed the toner from the toner cartridge to developer roll 116 in a substantially controlled and uniform manner as toner is consumed. An exemplary description of the structural interrelationship between a toner cartridge and a corresponding developer unit appears in U.S. patent application Ser. No. 11/686,614, filed Mar. 15, 2007 and assigned to the assignee of the present application. The combination of auger 106 and drive shaft 110 may be included in the developer unit or in the toner cartridge described in the application, or even in a housing providing a toner path between the toner cartridge and the developer unit. The content of the above-identified application is hereby incorporated by reference herein in its entirety.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. An apparatus for moving toner within an electrophotographic printer, comprising:

an auger having a length extending between two ends and having a radially inward facing surface, the radially inward facing surface defining an opening having an inner diameter, the opening extending along at least a portion of the length of the auger; and a drive shaft having an outer surface, the outer surface having an outer diameter, the outer diameter of the drive shaft being greater than the inner diameter of the auger when disengaged from the auger, wherein the radially inward facing surface of the auger engages the outer surface of the drive shaft with a first pressure when the drive shaft is rotated within the opening of the auger in a first direction with a first load applied to the drive shaft; and wherein the drive shaft has a proximal end portion and a distal end portion formed opposite to the proximal end portion, the distal end of the drive shaft having a stopping member disposed thereon to engage a rearward facing surface of the auger when the drive shaft is rotated in the first direction and a second direction.

2. The apparatus according to claim 1, wherein the drive shaft is made from a plastic material and the auger is made from a metal.

3. The apparatus of claim 1, wherein the drive shaft and the auger are made from different materials.

4. The apparatus of claim 1, wherein the auger is a metal auger and the drive shaft is made from a flexible material.

5. The apparatus of claim 4, wherein the drive shaft is made from a plastic material.

6. The apparatus according to claim 1, wherein the auger is a flat wire auger formed in a helical configuration extending throughout the length of the auger.

7. The apparatus according to claim 1, wherein the inner diameter of the radially inward facing surface of the auger is reduced when the drive shaft is rotated in the first direction so that the auger engages therewith in a substantially non-slip engagement.

8. The apparatus of claim 1, wherein the outer diameter of the drive shaft is greater than the inner diameter of the auger when disengaged from the drive shaft by about 0.17 mm.

9. The apparatus of claim 1, wherein the auger is a round wire auger.

10. A cleaner assembly for collecting waste toner within a printer cartridge comprising:

an auger having a length extending between two ends and having a radially inward facing surface, the radially inward facing surface defining an opening having an inner diameter, the opening extending along at least a portion of the length of the auger;

a drive shaft having an outer surface, the outer surface having an outer diameter, the outer diameter of the drive shaft being greater than the inner diameter of the auger, wherein the radially inward facing surface of the auger engages the outer surface of the drive shaft with a first pressure when the drive shaft is rotated within the opening of the auger in a first direction with a first load applied on the auger; and a waste toner box having a housing and an inlet and disposed on one of the two ends of the auger, a portion of the auger passing through the inlet into the housing for transferring a supply of waste toner therein when the drive shaft is rotated in the first direction;

wherein the drive shaft has a proximal end portion and a distal end portion formed opposite to the proximal end portion, the distal end of the drive shaft having a stopping member disposed thereon to engage a rearward facing surface of the auger when the drive shaft is rotated in the first direction and a second direction.

11. The cleaner assembly according to claim 10, wherein the radially inward facing surface of the auger contracts when the drive shaft is rotated in the first direction so as to grip the drive shaft in a substantially non-slip engagement.

12. The cleaner assembly according to claim 10, wherein the auger extends from a predetermined distance from an end of the drive shaft, at least a portion of the predetermined distance extending into the waste toner box.

13. The cleaner assembly according to claim 10, wherein the auger is a flat wire auger formed in a substantially helical configuration extending throughout the length of the auger.

14. The apparatus according to claim 10, wherein the auger is made from a flexible material.

15. The apparatus according to claim 14, wherein the drive shaft is made from a plastic material and the auger is made from a metallic material.

16. The apparatus of claim 10, wherein the drive shaft is made from a plastic material and the auger is a metal auger.

17. The apparatus of claim 10, wherein the auger is a round wire auger.

18. A device for moving particles, comprising:

an auger having a length extending between two ends and having a radially inward facing surface, the inward facing surface defining an opening having an inner diameter, the opening extending along at least a portion of the length of the auger; and a drive shaft having an outer surface, the outer surface having an outer diameter, the outer diameter of the drive shaft being greater than the inner diameter of the auger when disengaged from the auger, wherein the radially inward facing surface of the auger engages the outer surface of the drive shaft with a first pressure when the drive shaft is rotated within the opening of the auger in a first direction with a first load applied to the drive shaft, the engagement being a substantially non-slip engagement between the auger and the drive shaft;

wherein the drive shaft has a proximal end portion and a distal end portion formed opposite to the proximal end portion, the distal end of the drive shaft having a stopping member disposed thereon to engage a rearward facing surface of the auger when the drive shaft is rotated in the first direction and a second direction.

19. The device of claim 18, wherein the outer diameter of the drive shaft is greater than the inner diameter of the auger when disengaged from the drive shaft by about 0.17 mm.

20. An apparatus for moving toner within an electrophotographic printer, comprising:

an auger having a length extending between two ends and having a radially inward facing surface, the radially inward facing surface defining an opening having an inner diameter, the opening extending along at least a portion of the length of the auger; and a gated a drive shaft having an outer surface, the outer surface having an outer diameter, the outer diameter of the drive shaft being greater than the inner diameter of the auger when disengaged from the auger, wherein the radially inward facing surface of the auger engages the outer surface of the drive shaft with a first pressure when the drive shaft is rotated within the opening of the auger in a first direction with a first load applied to the drive shaft; and wherein the outer diameter of the drive shaft is greater than the inner diameter of the auger when disengaged from the drive shaft by about 0.17 mm.

* * * * *